US006076984A

United States Patent [19]

Legrain et al.

[11] Patent Number: 6,076,984

[45] Date of Patent: Jun. 20, 2000

[54] HOT MELT DEPILATORY WAX DISPENSER

[75] Inventors: Marc Legrain, Civrieux en Dombes; Sylvie Lacombe, Villeurbanne, both of France

[73] Assignee: SEB S.A., Ecully, France

[21] Appl. No.: 09/341,309

[22] PCT Filed: Nov. 12, 1998

[86] PCT No.: PCT/FR98/02410

§ 371 Date: Jul. 8, 1999

§ 102(e) Date: Jul. 8, 1999

[87] PCT Pub. No.: WO99/25217

PCT Pub. Date: May 27, 1999

[30] Foreign Application Priority Data

Nov. 13, 1997 [FR] France ..... 97 14465

[51] Int. Cl.[7] ..... A45D 40/00; A45D 40/26; A45D 34/04

[52] U.S. Cl. ..... 401/1; 401/2; 401/219; 401/220

[58] Field of Search ..... 401/1, 2, 5, 6, 401/9, 208, 219, 220

[56] References Cited

U.S. PATENT DOCUMENTS

| | | | |
|---|---|---|---|
| 2,029,056 | 1/1936 | Carlson . | |
| 2,229,707 | 1/1941 | Testi . | |
| 2,732,575 | 1/1956 | Faust | 401/5 |
| 2,888,695 | 6/1959 | Anderson et al. . | |
| 3,055,041 | 9/1962 | Schaich | 401/1 |
| 4,129,391 | 12/1978 | Gamacher | 401/208 |
| 5,395,175 | 3/1995 | Bontoux et al. | 401/1 |
| 5,803,636 | 9/1998 | Legrain et al. | 401/1 |
| 5,848,850 | 12/1998 | Bontoux et al. | 401/1 |

FOREIGN PATENT DOCUMENTS

| | | |
|---|---|---|
| 455 354 | 4/1991 | European Pat. Off. . |
| 786 214 | 7/1997 | European Pat. Off. . |
| 2 506 581 | 5/1981 | France . |
| 2 740 665 | 5/1997 | France . |
| 29 37 610 | 4/1981 | Germany . |
| 31 21 948 | 6/1981 | Germany . |
| 1045986 | 10/1966 | United Kingdom . |

OTHER PUBLICATIONS

Derwent Abstract, XP–002072798, Jan. 1996, AU950020417, filed May 31, 1995, priority of AU940006535, filed Jun. 28, 1994, re: Paint Application Roller.

*Primary Examiner*—Charles R. Eloshway
*Attorney, Agent, or Firm*—Pillsbury Madison & Sutro

[57] ABSTRACT

A depilatory wax dispenser having a housing (1) in which is arranged a reservoir (2) for the wax and an applicator device having a roller (5) mounted for rotation on a pivot pin (7). The pivot pin has two ends which extend through two opposite transverse walls (4a, 4b) of a rectangular opening (4) provided at the reservoir (2) outlet. The opening (4) has an edge which provides with the roller (5) peripheral surface a slot dispensing melted wax. The opening (4) edge and the roller (5) peripheral surface between which the slot is arranged are made of elastically deformable materials. An element (10) is axially mobile relative to the pivot pin (7) for simultaneously exerting a force on the rectangular opening (4) edge forming the slot and on the roller (5) surface, for deforming them jointly.

4 Claims, 1 Drawing Sheet

HOT MELT DEPILATORY WAX DISPENSER

This application is the national phase of international application PCT/FR98/02410 filed Nov. 12, 1998 which designated the U.S.

TECHNICAL FIELD

The present invention relates to a hot melt depilatory wax dispenser.

PRIOR ART

Depilatory wax appliances are known in which the wax is melted and then spread on the skin, and after solidification removed, which permits plucking of hairs imbedded in the hardened wax layer. According to one type of appliance of this sort, the wax is melted in a reservoir, then spread on the skin with an applicator having a roller disposed in an opening placed at the outlet of the wax reservoir, a calibrated space being arranged between this opening and the roller. This latter is driven by applying it against the skin and displacing the appliance, thus forming a wax layer of a thickness and a determined width which is deposited on the skin.

Taking into account the morphology of the parts of the body from which hair is to be removed, the generally cylindrical form of the rollers utilized for the application of the wax is not always suitable. This is notably the case under the armpits where, taking into account the concavity of the surface on which the wax must be applied, the edges of the cylindrical roller rub against the skin, interfering with comfort and effectiveness, the edges of the layer of wax being subjected to a higher pressure, which diminishes their thickness.

There has already been proposed in GB-363 744 an applicator for glue with the aid of a roller pivotally mounted in a rectangular opening. To permit this opening to be freed of glue which has hardened during non-use of the applicator during a certain time, the applicator roller is made of an elastically deformable material, in such a manner that by pressing on this roller its deformation permits the hardened glue film to be broken.

There have been proposed in U.S. Pat. No. 2 029 056 as well as in EP 0 437 042 applicators for cosmetic products comprising rollers having a convex generatrix to apply these products onto concave surfaces. In contrast, these appliances are not adapted for applying these products onto more or less flat surfaces, so that several appliances or an appliance with a removable application head are then necessary. This latter solution has already been proposed, notably to adapt rollers to different widths, however it is a question of a solution which is inappropriate, necessitating the manipulation of heads which are sticky with wax.

There exists another category of applicators described for example in U.S. Pat. No. 2 229 707, U.S. Pat. No. 2 888 695, U.S. Pat. No. 1 919 859 and U.S. Pat. No. 1565 179, relative to applicators for glue or cosmetic products comprising either a flexible housing, or a support for a flexible applicator roller, or even a flexible duct to assure either a closing or an opening of the reservoir of the product to be distributed, or a variable flow rate, as a function of the deformation applied to the flexible part.

There has been proposed moreover, in FR-2 662 145 an applicator for a liquid, viscous or pasty product furnished with an applicator comprising a cap having an outlet slot in which engages a deformable tongue which liberates more or less of the product.

There has been proposed in FR-A1-2 740 665 an appliance for applying depilatory wax in which the wax application head is formed of several coaxial rollers at least one of which can be blocked angularly, so that the width of the ribbon of wax deposited is then reduced and corresponds to that of the single roller which remains free to turn. This solution presents however the difficulty of leaving the roller angularly blocked in contact with the skin, creating a disagreeable rubbing. It is moreover obvious that such an application head does not resolve the problem of application of wax on a concave surface, since if the deposited wax band is narrower, the width of the rollers, as well their profile remain unchanged, so that the extremities of the rollers forming a cylinder will come alone into contact with the concave surface.

It is easy to note that none of the above-mentioned solutions proposes an applicator for a liquid or pasty product permitting adaptation as well to concave, flat or even convex surfaces.

SUMMARY OF THE INVENTION

The object of the present invention is to remedy, at least in part, the above-mentioned difficulties, by a solution which is simple as well from the point of view of fabrication as of utilization, all while being reliable and sturdy.

To this end, the invention has for its object a hot melt depilatory wax dispenser comprising a housing forming a holding means, within which is arranged a reservoir for the wax associated with heating means and an applicator device comprising a roller rotatably mounted on a pivot pin whose ends extend through two opposed transverse walls of a rectangular opening arranged at the outlet of said reservoir, the edge of this opening providing with the peripheral face of this roller a slot for the distribution of melted wax upon rotation of this roller.

According to the object of the invention, the edge of said opening and the peripheral surface of the roller between which said slot is provided are of elastically deformable materials. This appliance comprises means which are axially displaceable with respect to the axis of said pivot pin in order to exert a force simultaneously on the edge of the rectangular opening forming said slot and on the surface of said roller, capable of deforming them jointly, in a manner to modify the profile of said slot.

As a result of this arrangement, not only the surface of the roller can be adapted to the morphology of the surface from which hair is to be removed, but the edge of the opening follows this deformation, without which the wax could no longer exit over the entire length of this slot because the swelling of the roller would close it.

According to an advantageous form of construction, one of the transverse walls of said opening is fixed along said pin, while the other is movable, pivoting means (for example a ball bearing) being interposed between each of these transverse faces and one of the extremities of said roller, said axially displaceable means comprising a nut adjacent to the external face of the moveable transverse wall of said rectangular opening, engaged with a thread to displace this moveable wall as well as the adjacent extremity of said roller in the direction of the opposed wall. The pivoting means permit the roller to turn freely despite the pressure transmitted by the transverse walls of the opening on the end walls of the roller to deform its peripheral wall.

Preferably, the transverse walls of the opening, as well as the end faces of the roller are substantially nondeformable with respect to the longitudinal walls of this opening and to the peripheral face of said roller. This "rigidity" of the transverse walls of the opening and of the end faces of the roller permit these faces to be used efficiently to transmit in a uniform manner the force of the axially displaceable means to deform the edges of the opening and the peripheral face of the roller.

Advantageously, the peripheral wall of said roller has the form of a tubular element whose two extremities are fixed to rigid discs. This peripheral wall of the roller formed by an elastically deformable tubular element between two rigid discs facilitates the deformability of the roller. It can also permit, when the roller is not axially compressed by the axially displaceable means slight bending on contact with a convex surface.

BRIEF DESCRIPTION OF THE DRAWINGS

The invention will be better understood from a study of the embodiment provided in a manner which is not limiting and is schematically illustrated in the attached Figures in which.

BEST MANNER OF CARRYING OUT THE INVENTION

Figure 1:
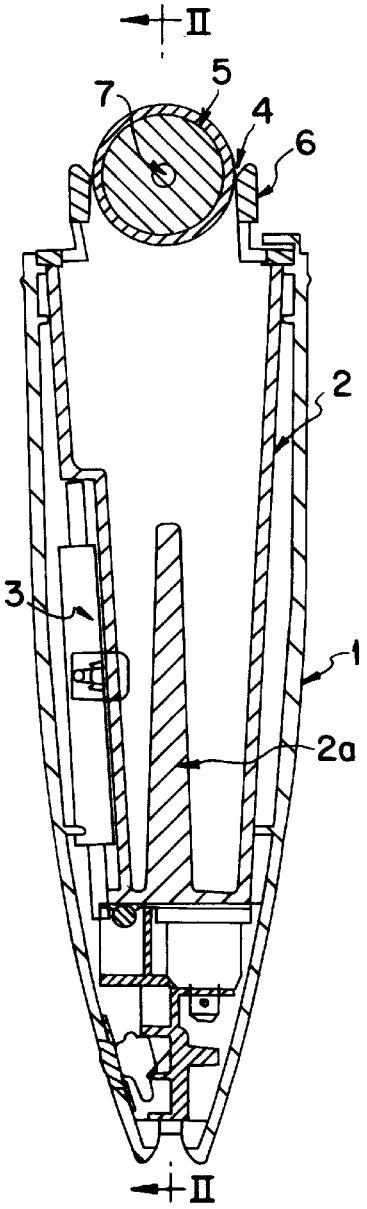
FIG. 1 is a cross-section along I—I of FIG. 2 of this embodiment of the invention.
Figure 2:
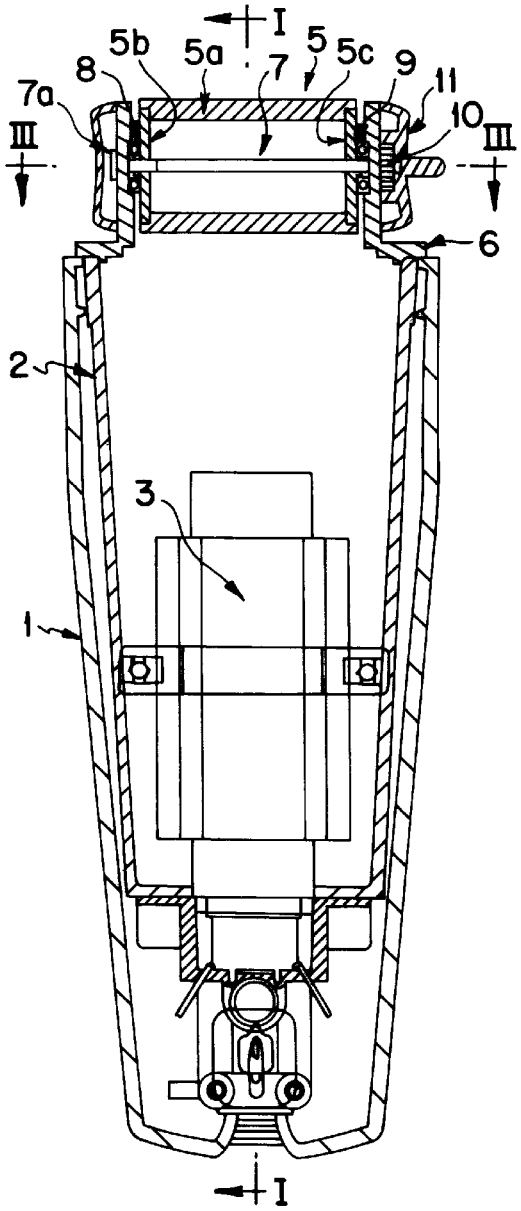
FIG. 2 is a cross-section along II—II of FIG. 1.

The wax dispenser illustrated in the drawings comprises a housing 1, at the interior of which is found a reservoir 2 intended to receive the depilatory wax. An electric heating body 3 is fixed to one of the walls of this reservoir 2 at the interior of which extends a heat diffusion fin 2*a*. A rectangular opening 4 is formed at the top of this reservoir 2 and is formed through a support piece 6 closing the upper extremity of reservoir 2.

A wax applicator device is disposed in opening 4 of reservoir 2. This applicator device comprises a roller 5 whose peripheral face is formed of a tubular element 5*a* of an elastically deformable material, closed at its two ends by two discs 5*b*, 5*c*, preferably rigid with respect to tubular element 5*a*. This roller 5 is pivotally mounted on a pin 7 passing freely through discs 5*b*, 5*c* and the two ends of which are mounted across the two transverse walls 4*a*, 4*b* (FIG. 3) of rectangular opening 4. As is seen in particular on FIGS. 1 and 3, a slot is formed at each side of the peripheral face of roller 5. These slots are bounded by edges 4*c*, 4*d* of opening 4 and the peripheral wall of roller 5, permitting the molten wax to leave reservoir 2 in the form of a thin layer, as a result of the rotation of roller 5. The wax can leave by one or the other slot depending on the direction of rotation of roller 5.

Transverse walls 4*a*, 4*b* of rectangular opening 4 formed through support 6 are relatively rigid, while longitudinal walls 4*c*, 4*d* are elastically deformable. This result can be obtained in different ways, for example, by molding support 6 of a supple material, such as a thermoplastic elastomer, and by disposing in the mold a relatively more rigid armature in walls 4*a*, 4*b*. One can also use a bi-injection technique consisting of injecting two plastic materials one more supple than the other to form the support part 6 which must be more rigid with a first material and the walls 4*c*, 4*d* of a more supple material.

Two ball bearings 8, 9 are disposed respectively between transverse face 4*a* of opening 4 and end face 5*b* of roller 5 and between transverse face 4*b* of opening 4 and end face 5*c* of roller 5.

Figure 4:
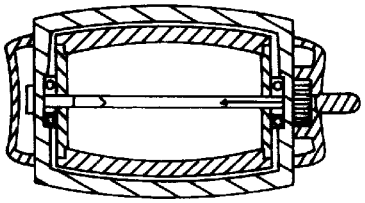
FIG. 4 is a view identical to FIG. 3, of this applicator device in a second position.

One end of pin 7 is terminated by a head 7*a* which bears against the external face of transverse wall 4*a*, while the other extremity of this pin 7 has a thread engaged with a nut 10 bearing against the external face of transverse wall 4*b* of opening 4. This nut 10 is fixed in rotation with a control button 11. By this fact, by screwing nut 10 along pin 7 in the direction of the other end terminating by the head 7*a*, a pressure is exerted on the face 4*b* and since the opposed face 4*a* is retained by the head 7*a*, displacement of nut 10 produces a joint deformation of edges 4*c*, 4*d* of opening 4 and of the peripheral wall of roller 5, as shown in FIG. 4. This joint deformation thus permits conserving a dispensing slot having a practically constant width between the peripheral face of roller 5 and opening 4.

Figure 3:
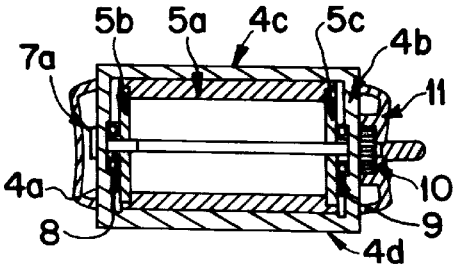
FIG. 3 is a partial cross-section along III—III of FIG. 2, of the applicator device in a first position.

Due to the presence of bearings 8, 9 between the ends of roller 5 and the transverse edges of opening 4, the axial pressure exerted to deform this roller 5 does not have an influence on its rotation. Among the advantages of this device, one can also mention that the supple material utilized for roller 5 provides a softer and thus more agreeable contact with the skin. In addition, according to a preferred embodiment, the peripheral wall of this roller 5 is formed with the aid of a supple tubular element 5*a*, permitting it to mate more closely with the profile of the surface on which the wax must be applied, when the peripheral surface of roller 5 is not placed under tension by nut 10. In effect, when roller 5 is utilized in its nondeformed state, as illustrated by FIG. 3, its peripheral surface can mate with, to a certain extent, the profile of the surface on which the wax must be deposited, for example a slight convexity of this surface.

POSSIBILITIES OF INDUSTRIAL APPLICATION

The invention finds its application in the field of wax depilatory appliances and particularly in that of appliances for the general public.

What is claimed is:

1. Hot melt depilatory wax dispenser comprising a housing (1) forming a holding means, at the interior of which is arranged a reservoir (2) for the wax associated with heating means (3) and an applicator device comprising a roller (5) rotatably mounted on a pivot pin (7) whose ends extend through two opposed transverse walls (4*a*, 4*b*) of a rectangular opening (4) arranged at the outlet of said reservoir (2), the edge of this opening (4) creating with the peripheral face of this roller (5) a dispensing slot for the molten wax resulting from the rotation of this roller (5), characterized in that the edge of said opening (4) and the peripheral surface of the roller (5) between which said slot is arranged are of elastically deformable materials and in that it comprises means (10) which are axially displaceable with respect to the axis of said pivot pin (7) to simultaneously exert a force on the rectangular opening (4) creating said slot and on the surface of said roller (5) capable of deforming them jointly, in a manner to modify the profile of said slot.

2. Dispenser according to claim 1, characterized in that one (4*a*) of the transverse walls (4*a*, 4*b*) of said opening (4) is fixed along said pin (7), while the other (4*b*) is movable, rotating means (8, 9) being interposed between each of these transverse walls (4*a*, 4*b*) and one of the ends (5*b*, 5*c*) of said roller (5), said axially displaceable means (10) comprising a nut (10), adjacent to the external face of the moveable transverse wall (4*b*) of said rectangular opening (4), engaged with a thread, in order to displace said mobile wall (4*b*) as well as the adjacent end of said roller (5) in the direction of the fixed transverse wall (4*a*).

3. Dispenser according to claim 1, characterized in that said transverse walls (4*a*, 4*b*) of said opening (4) as well as the end faces (5*b*, 5*c*) of said roller (5) are substantially nondeformable with respect to the longitudinal walls (4*c*, 4*d*) of this opening (4) and to the peripheral face of said roller (5).

4. Device according to claim 1, characterized in that the peripheral wall of said roller (5) has the form of a tubular element (5*a*) of which the two ends are fixed to rigid discs (5*b*, 5*c*).

* * * * *